US005621946A

United States Patent [19]

Lee

[11] Patent Number: 5,621,946

[45] Date of Patent: Apr. 22, 1997

[54] SUCTION TUBE MOUNTED WITH AN AUXILIARY BRUSH OF A VACUUM CLEANER

[75] Inventor: Nam-Ho Lee, Seoul, Rep. of Korea

[73] Assignee: Daewoo Electronics Co., Ltd., Seoul, Rep. of Korea

[21] Appl. No.: 578,484

[22] Filed: Dec. 26, 1995

[30] Foreign Application Priority Data

Dec. 26, 1994 [KR] Rep. of Korea ..... 94-36826
Dec. 29, 1994 [KR] Rep. of Korea ..... 94-38982

[51] Int. Cl.[6] ..... A47L 9/06

[52] U.S. Cl. ..... 15/373; 15/377; 15/398

[58] Field of Search ..... 15/377, 398, 399, 15/400, 368, 373

[56] References Cited

U.S. PATENT DOCUMENTS

| | | | |
|---|---|---|---|
| 969,913 | 9/1910 | Spencer | 15/399 X |
| 2,321,231 | 6/1943 | Missmer | 15/398 |
| 2,351,507 | 6/1944 | Hallock | 15/398 X |
| 3,259,934 | 7/1966 | Leinfelt | 15/399 X |
| 4,897,894 | 2/1990 | Fahlen | 15/398 X |
| 5,502,870 | 4/1996 | Ragner et al. | 15/398 X |

*Primary Examiner*—Chris K. Moore
*Attorney, Agent, or Firm*—Beveridge, DeGrandi, Weilacher & Young LLP

[57] ABSTRACT

A suction tube mounted with an auxiliary brush of a vacuum cleaner separates coupled extension pipes from each other while projecting the auxiliary brush from the suction tube, and couples the extension pipes with each other while retreating the auxiliary brush from the preceding end of the suction tube which includes the first extension pipe, second extension pipe and auxiliary brush slidably mounted to the outer periphery of the first extension pipe in the lengthwise direction. The auxiliary brush is biased toward the front side of the first extension pipe by a biasing member and retreats toward the rear side of the first extension pipe by a retracting member. The suction pipe further has a latching unit for latching the second extension pipe into the first extension pipe while maintaining the auxiliary brush on the retreating position from the preceding end of the first extension pipe when the second extension pipe is completely inserted into the first extension pipe and releasing the latching by the manipulation of a press button.

14 Claims, 13 Drawing Sheets

SUCTION TUBE MOUNTED WITH AN AUXILIARY BRUSH OF A VACUUM CLEANER

BACKGROUND OF THE INVENTION

1. Field of the Invention

The present invention relates to a suction tube mounted with an auxiliary brush of a vacuum cleaner, and more particularly to a suction tube mounted with an auxiliary brush of a vacuum cleaner, in which an auxiliary brush is used and stored under the state of being mounted to any one of extension pipes forming the suction tube of the vacuum cleaner.

2. Description of the Prior Art

An external appearance of a conventional vacuum cleaner is schematically illustrated in FIG. 5 of U.S. Pat. No. 5,054,156 and FIG. 5 of U.S. Pat. No. 5,101,534. FIG. 1 shows the schematic construction of the conventional vacuum cleaner as illustrated in FIG. 5 of U.S. Pat. Nos. 5,054,156 and 5,101,534. Referring to FIG. 1, the vacuum cleaner typically includes a cleaner body 10 having a vacuum pump (not shown) and a dirt bag (not shown) therein, and a suction nozzle 20 which has an intake passageway (not shown) for sucking dirt-laden air and a brush (not shown) serving for directing the dirt and the like over a floor toward an inlet opening (not shown) of the intake passageway. In addition to these, the vacuum cleaner has a suction tube 30 consisting of a plurality of extension pipes 30*a*, 30*b* and 30*c* which connect suction nozzle 20 to cleaner body 10 while affording a passage of the dirt-laden air into cleaner body 10 via suction nozzle 20, and a flexible tube 40.

However, suction nozzle 20 of the general vacuum cleaner as shown in FIG. 1 is shaped unsuitable for the cleaning of corners such as the border lines of walls and the floor or a dented portion in a window frame (hereinafter simply referred to as corner portions). Thus, when cleaning the corner portions, it is common practice to separate suction nozzle 20 or extension pipes 30*a* and 30*b* from the preceding end of extension pipes 30*a*, 30*b* or 30*c*, and an auxiliary brush 50 shaped to be suitable for the cleaning of the corner portions is mounted instead, thereby carrying out the cleaning work (refer to FIG. 2). One example of the auxiliary brush of the vacuum cleaner used as the above manner is disclosed in U.S. Pat. No. 4,897,894 entitled: "Vacuum Cleaner Nozzle."

But such auxiliary brush 50 is usually small in size and stored separately from the extension pipes, thereby highly liable to be lost. FIGS. 3 to 4C illustrate a conventional vacuum cleaner having a suction tube mounted with an auxiliary brush which is coupled with the suction tube of the vacuum cleaner in one-piece to be used and stored so as to inhibit the possible loss thereof.

A suction tube 100 mounted with the auxiliary brush of the aforementioned conventional vacuum cleaner consists of an extension pipe 110 and an auxiliary brush 111 rotatably mounted to the preceding end of extension pipe 110. Auxiliary brush 111 is formed by a brush body 112 and a dust brush 115 integrally molded into one end of brush body 112. Auxiliary brush 111 is mounted to be rotatable about the preceding end of extension pipe 110 by approximately 180°. For this reason, one plane among four planes of auxiliary brush 111 has no brush body 112 and dust brush 115.

Suction tube 100 mounted with auxiliary brush 111 of the conventional vacuum cleaner constructed as above is pulled backward to force dust brush 115 of auxiliary brush 111 to face extension pipe 110 when auxiliary brush 111 is not available. Therefore, when another extension pipe 121 is inserted into an inlet of extension pipe 110, dust brush 115 is not damaged due to another extension pipe 121 (refer to FIG. 4A). Whereas, when auxiliary brush 111 is utilized, dust brush 115 of auxiliary brush 111 expands to face the outer preceding end of extension pipe 110 to perform the cleaning of the corner portions (refer to FIG. 4B). Auxiliary brush 111 may be utilized under a state of expanding by half without thoroughly expanding against extension pipe 110 as shown in FIG. 4C.

However, in suction tube 100 mounted with auxiliary brush 111 of the conventional vacuum cleaner, brush body 112 and dust brush 115 are not provided in one plane among the four planes of auxiliary brush 111 to thus open the one plane. Consequently, between auxiliary brush 111 and a place subjected to be cleaned, a space is incurred owing to the plane without involving brush body 112 and dust brush 115, which significantly degrades cleaning efficiency.

Furthermore, when a user handles auxiliary brush 111 in above-described suction tube 100 mounted with auxiliary brush 111 of the conventional vacuum cleaner, another extension pipe 121 is separated out of extension pipe 110 from the preceding end of extension pipe 110, and then auxiliary brush 111 rotatably mounted to the preceding end of extension pipe 110 is pulled back. In addition, when auxiliary brush 111 is not used, after the auxiliary brush 111 is rotated in the reverse direction to the above operation to be closely attached to extension pipe 110, another extension pipe 121 is coupled to extension pipe 110, etc. These operations are troublesome in using the vacuum cleaner.

SUMMARY OF THE INVENTION

To solve the foregoing problems of the suction tube mounted with the auxiliary brush in the conventional vacuum cleaner, an object of the present invention is to provide a suction tube mounted with an auxiliary brush of a vacuum cleaner with no open portion in any plane of a brush body and a dust brush to block an occurrence of a space formed between the auxiliary brush and a plane to be cleaned, for separating coupled extension pipes from one another while protruding the auxiliary brush from the suction tube, and coupling the extension pipes with one another while retreating the auxiliary brush from the preceding end of the suction tube only by a simple manipulation.

To achieve the object of the present invention, a suction tube mounted with an auxiliary brush of a vacuum cleaner includes a first extension pipe and a second extension pipe having a neck inserted into the interior of the first extension pipe. Also, the auxiliary brush having a brush body and a dust brush integrally formed with the brush body in one piece is mounted to the outer periphery of the first extension pipe to be slidably moved in the lengthwise direction of the first extension pipe, and biased by a unit toward the front side of the first extension pipe. Another unit in opposition to the biasing unit retracts the auxiliary brush toward the rear side of the first extension pipe, and a latching unit having a press button latches the second extension pipe into the first extension pipe when the second extension pipe is completely inserted within the first extension pipe while maintaining the auxiliary brush at a position retreating from the preceding end of the first extension pipe, and the latching is released by the manipulation of the press button.

Preferably, the biasing unit includes a pair of backing ledges formed to an outer side of both sidewalls of an extension pipe body of the first extension pipe, a pair of spring grooves formed in the inner side of both sidewalls of the brush body of the auxiliary brush for accommodating the backing ledges to one rear sides of them, and a pair of springs respectively having one ends supported by the backing ledges and the other ends supported by one preceding ends of the spring grooves to be held within the spring grooves.

Preferably, the retracting unit includes a pair of juts embeddedly projecting from both inner walls of a slit formed in a bottom wall of the brush body of the auxiliary brush to be accommodated within a slot formed in the bottom wall of the extension pipe body of the first extension pipe for moving backward and forward within the slot, and a bottom protrusion formed to an outer side of a bottom wall of the neck of the second extension pipe.

It is preferable that the latching unit includes a latching member pivotally coupled to a subplate of the first extension pipe, in which the latching member has a hook-shaped latch on one front side and a press button on the opposite side of the latch being biased by means of a spring with respect to the subplate to project by penetrating through a through hole formed in the extension pipe body of the first extension pipe. In addition, the latching unit has a hooking jaw formed to an outer side of the upper wall of the neck of the second extension pipe to be fitted with the latch of the latching member.

In the suction tube mounted with the auxiliary brush of the vacuum cleaner according to the present invention constructed as above, once the second extension pipe is inserted into the first extension pipe when the auxiliary brush is not used, the bottom protrusion of the second extension pipe is advanced into the slot formed in the extension pipe body of the first extension pipe. In turn, the bottom protrusion of the advancing second extension pipe pushes the pair of juts of the auxiliary brush with the consequence of retreating the auxiliary brush to the rear side of the first extension pipe. By the insertion of the second extension pipe to the first extension pipe, the hooking jaw of the second extension pipe comes in contact with the latch of the latching member, and the preceding end of the latch ascends along the rear slanted plane of the hooking jaw. Once the second extension pipe further advances into the first extension pipe, the hooking jaw goes through the preceding end of the latch. However, since the latching member formed with the latch is pivotally supported by the subplate of the first extension pipe by means of the spring in the opposite side of the latch, the preceding end of the latch then descends by the spring. Accordingly, the latch of the first extension pipe is fitted with the hooking jaw of the second extension pipe. Therefore, the second extension pipe is joined into the first extension pipe. At the same time, the auxiliary brush retreats from the preceding end of the first extension pipe to be safely stored.

In the meantime, if the user intends to use the auxiliary brush, the second extension pipe is separated from the first extension pipe while the auxiliary brush projects out of the preceding end of the first extension pipe only by the user's pressing of the press button which protrudes by penetrating through the through hole formed in the extension pipe body of the first extension pipe. In more detail, when the user presses the press button with a finger, the latch formed to the opposite side of the press button from a pivot point is upwardly moved centering about the pivot point since the latching member having the press button thereon is pivotally supported by the subplate of the first extension pipe. If the preceding end of the latch is further moved upward to be free from the upper end of the hooking jaw of the second extension pipe, the auxiliary brush biased in a direction from a stopper to the press button of the first extension pipe (hereinafter, called "in a forward direction of the first extension pipe) by means of the pair of springs is moved in the forward direction of the first extension pipe. Therefore, the second extension pipe is also separated out of the first extension pipe by the pair of juts of the auxiliary brush and the bottom protrusion of the second extension pipe. By simply pressing the press button as described above, the auxiliary brush projects from the preceding end of the first extension pipe by the force of the pair of springs. As the result, the user can carry out the cleaning work by using the auxiliary brush.

Thus, in the suction tube mounted with the auxiliary brush of the vacuum cleaner according to the present invention constructed as above, just the simple manipulation of inserting the second extension pipe to the first extension pipe simultaneously enables two manipulations of retreating the auxiliary brush from the preceding end of the first extension pipe and coupling the second extension pipe to the first extension pipe. Also, the manipulation of simply pressing the press button simultaneously separates the second extension pipe from the first extension pipe and projects the auxiliary brush out of the preceding end of the first extension pipe. As a consequence, the extension pipes are coupled with each other and the auxiliary brush can retreat from the preceding end of the suction tube by the simple manipulation which further separates the extension pipes from each other and projects the auxiliary brush from the preceding end of the suction tube.

In addition to the above advantages, there is no need to open any portion of the brush body and dust brush of the auxiliary brush mounted to the first extension pipe in the suction tube mounted with the auxiliary brush of the vacuum cleaner according to the present invention constructed as above. Thus, a space brought about when the auxiliary brush comes in contact with a plane subjected to cleaning is not incurred between the auxiliary brush and the plane cleaned, thereby preventing the degradation of cleaning efficiency caused by the above space.

Also, there is provided a suction tube mounted with an auxiliary brush of a vacuum cleaner including a first extension pipe, and a second extension pipe having a neck inserted into the interior of the first extension pipe. The auxiliary brush mounted to the outer periphery of the first extension pipe to be slidable in the lengthwise direction of the first extension pipe has a brush body and a dust brush integrally formed with the brush body in one piece, and biased by a unit toward the front side of the first extension pipe. Another unit in opposition to the biasing means retracts the auxiliary brush toward the rear side of the first extension pipe, and a latching unit latches the second extension pipe into the first extension pipe while maintaining the auxiliary brush at a position retreating from the preceding end of the first extension pipe when the second extension pipe is completely inserted within the first extension pipe, and fixes the auxiliary brush to a prescribed projecting position with respect to the first extension pipe when the latching is released to project the auxiliary brush from the preceding end of the first extension pipe.

Preferably, the biasing unit includes a pair of backing ledges formed to an outer side of both sidewalls of an extension pipe body of the first extension pipe, a pair of spring grooves formed in the inner side of both sidewalls of the brush body of the auxiliary brush for accommodating the backing ledges to one rear sides of them, and a pair of springs respectively having one ends supported by the backing ledges and the other ends supported by one preceding ends of the spring grooves to be held within the spring grooves.

It is also preferabe that the retracting unit includes a pair of juts embeddedly projecting from both inner walls of a slit formed in a bottom wall of the brush body of the auxiliary brush to be accommodated within a slot formed in the bottom wall of the extension pipe body of the first extension pipe for moving backward and forward within the slot, and a bottom protrusion formed to an outer side of a bottom wall of the neck of the second extension pipe.

The latching unit preferably includes a latching member pivotally coupled to a subplate of the first extension pipe. The latching member has a hook-shaped latch on one rear end thereof, a press button biased by means of a spring with respect to the subplate to project by penetrating through a through hole formed in the extension pipe body of the first extension pipe on one front end thereof and an auxiliary brush fixing protrusion to one rear side of the press button. The latching unit further has a latching groove formed in the outer side of the upper wall of the neck of the second extension pipe to be fitted with the latch of the latching member, and an auxiliary brush fixing protrusion holding groove formed in the inner side of the brush body of the auxiliary brush for being fitted with the auxiliary brush fixing protrusion of the latching member.

In the suction tube mounted with the auxiliary brush of the vacuum cleaner according to the present invention constructed as above, once the second extension pipe is inserted into the first extension pipe when the auxiliary brush is not used, the end of the neck of the second extension pipe comes in contact with the latch of the latching member. In turn, the latching member is rotated while centering about a pivot point to ascend the latch. As the latching member is rotated, the auxiliary brush fixing protrusion formed on the opposite side of the latch begins descending, so that the auxiliary brush fixing protrusion is shifted away from the auxiliary brush fixing protrusion holding groove in the brush body. Then, once the second extension pipe is further advanced within the first extension pipe, the bottom protrusion formed to the neck of the second extension pipe is advanced into the slot formed in the extension pipe body of the first extension pipe, and the bottom protrusion of the advancing extension pipe is fitted with the pair of juts of the auxiliary brush. Thereafter, along with the further advancing of the second extension pipe into the first extension pipe, the auxiliary brush also retreats to the rear side of the first extension pipe. If the second extension pipe further advances into the first extension pipe, the dust brush of the auxiliary brush thoroughly retreats from the preceding end of the first extension pipe. At this time, the preceding end of the latch is placed on the latching groove formed in the neck of the second extension pipe. However, since the latching member formed with the latch is pivotally supported by the subplate and biased by the spring in the opposite side of the latch centering about the pivot point, the preceding end of the latch then descends by means of the spring. Accordingly, the latch of the first extension pipe is fitted into the latching groove of the second extension pipe. Therefore, the second extension pipe is joined into the first extension pipe. At the same time, the auxiliary brush retreats from the preceding end of the first extension pipe to be safely stored.

In the meantime, if the user intends to use the auxiliary brush, the second extension pipe is separated from the first extension pipe while the auxiliary brush projects out of the preceding end of the first extension pipe only by the user's pressing of the press button which protrudes by penetrating through the through hole formed in the extension pipe body of the first extension pipe. In more detail, when the user presses the press button with the finger, the latch formed to the opposite side of the pivot point is upwardly moved centering about the pivot point since the latching member having the press button thereon is pivotally supported by the subplate of the first extension pipe. Therefore, the latch is shifted away from the latching groove of the second extension pipe. The auxiliary brush biased in a forward direction of the first extension pipe by means of the pair of springs is moved in the forward direction of the first extension pipe. Thus, the second extension pipe is also separated out of the first extension pipe by the pair of juts of the auxiliary brush and bottom protrusion of the second extension pipe. The auxiliary brush is moved until the rear end of the first elongated hole comes in contact with the stopper formed to the extension pipe body of the first extension pipe. When the rear side of the first elongated hole contacts the stopper to stop the movement of the auxiliary brush, the auxiliary brush fixing protrusion holding groove formed in the inner side of the brush body of the auxiliary brush is placed to the upper side of the auxiliary brush fixing protrusion of the latching member. At this time, if the user removes his finger from the press button, the auxiliary brush fixing protrusion ascends to be fitted into the auxiliary brush fixing protrusion holding groove. By simply pressing the press button described as above, the auxiliary brush projects from the preceding end of the first extension pipe to be secured to a prescribed position.

Thus, in the suction tube mounted with the auxiliary brush of the vacuum cleaner according to the present invention constructed as above, just the simple manipulation of inserting the second extension pipe to the first extension pipe simultaneously enables two manipulations of retreating the auxiliary brush from the preceding end of the first extension pipe and coupling the second extension pipe to the first extension pipe. Also, the manipulation of simply pressing the press button simultaneously separates the second extension pipe from the first extension pipe and projects the auxiliary brush out of the preceding end of the first extension pipe. As a consequence, the extension pipes are coupled with each other and the auxiliary brush can retreat from the preceding end of the suction tube by the simple manipulation which further separates the extension pipes from each other and projects the auxiliary brush from the preceding end of the suction tube.

Besides, even when the cleaning is performed by pushing the auxiliary brush to the place cleaned, the auxiliary brush is not pushed against the first extension pipe since the auxiliary brush is fixed to the first extension pipe by the engagement of the auxiliary brush fixing protrusion and auxiliary brush fixing protrusion holding groove in the suction tube mounted with the auxiliary brush of the vacuum cleaner to be able to execute the efficient cleaning work.

In addition to the above advantages, there is no need to open any portion of the brush body and dust brush of the auxiliary brush mounted to first extension pipe in the suction tube mounted with the auxiliary brush of the vacuum cleaner according to the present invention constructed as above. Thus, a space is not incurred between the auxiliary brush and a plane subjected to cleaning, which is brought about when the auxiliary brush comes in contact with the plane cleaned, thereby preventing degradation of cleaning efficiency caused by the above space.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Figure 1:
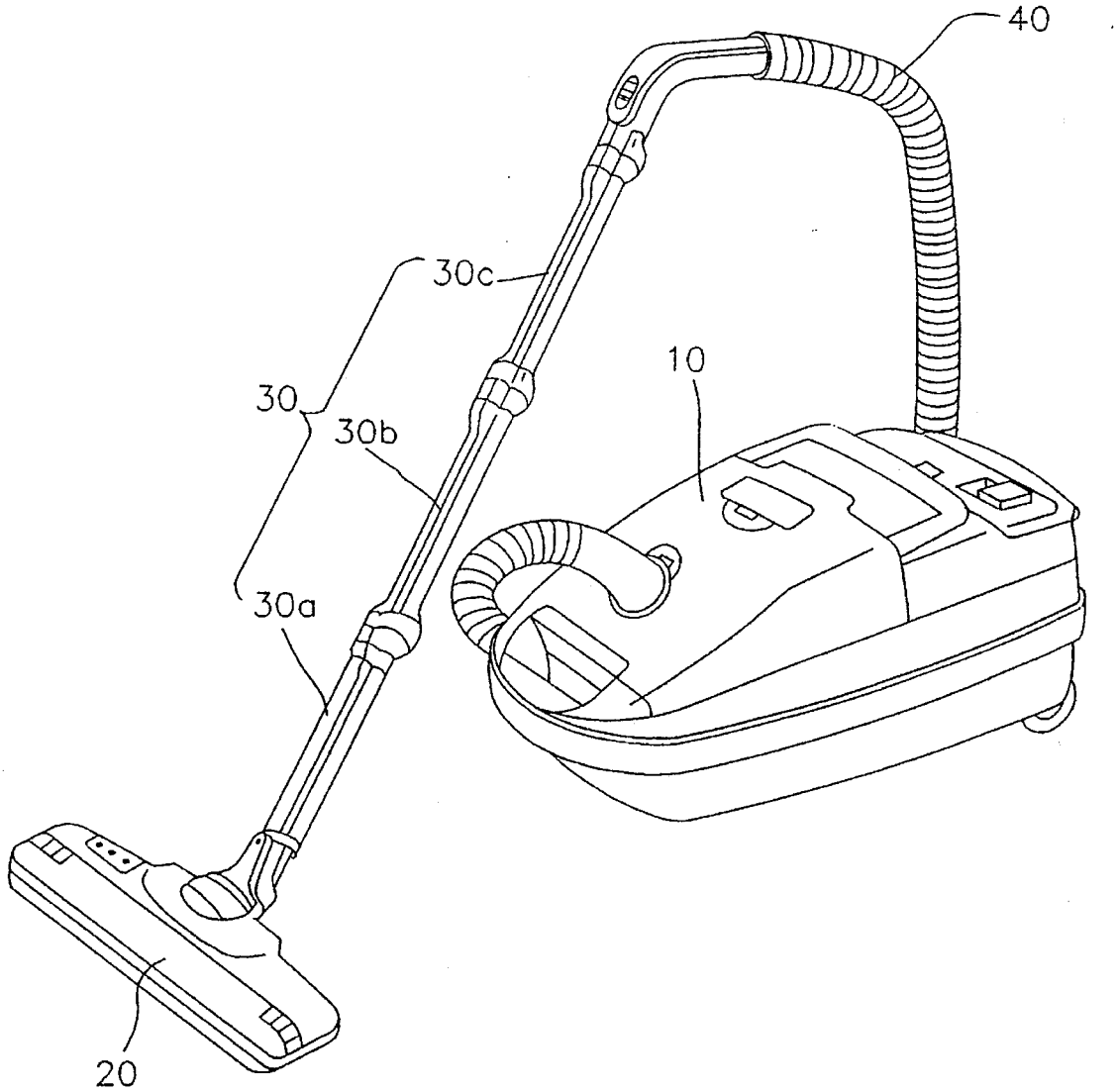
FIG. 1 is a perspective view showing a structure of an external appearance of a general vacuum cleaner.
Figure 2:
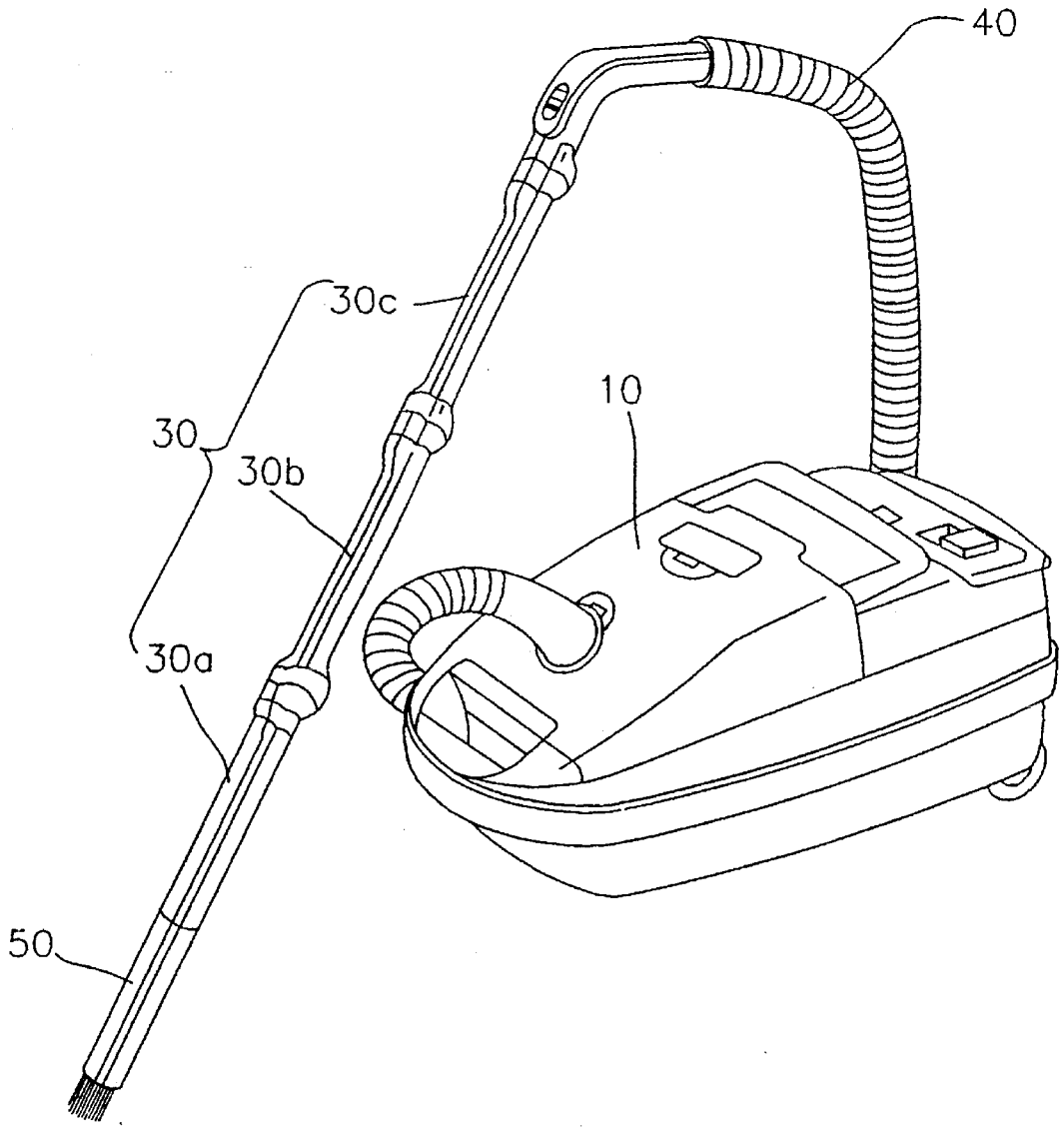
FIG. 2 is a view showing a state that the suction nozzle is separated from the vacuum cleaner as shown in FIG. 1 and the auxiliary brush is mounted thereto.
Figure 3:
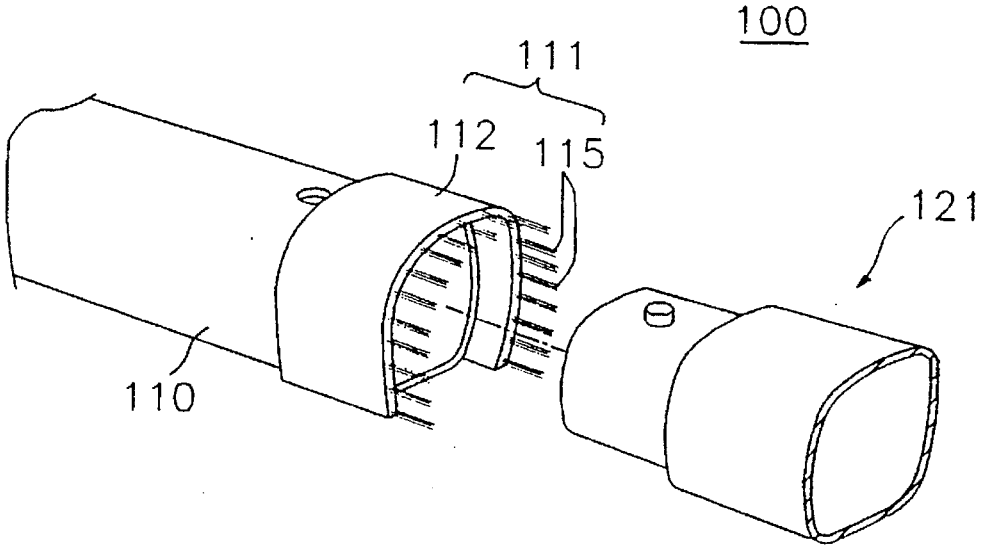
FIG. 3 is a perspective view showing the suction tube mounted with the auxiliary brush of the conventional vacuum cleaner.
Figure 4A:
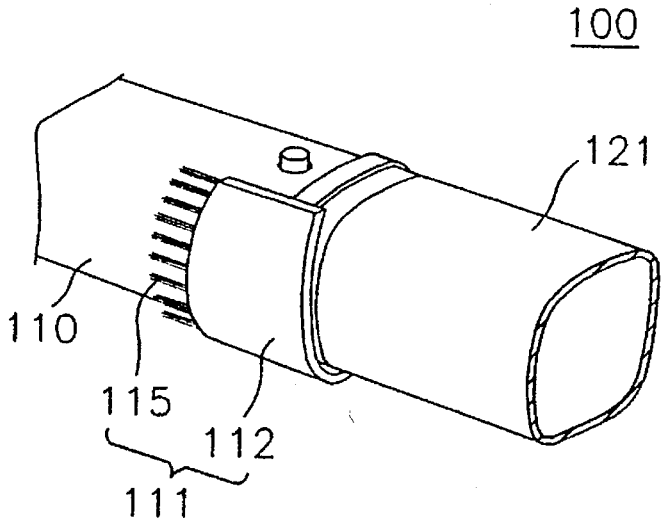
FIG. 4A is a view illustrating a state of using the suction tube mounted with the conventional auxiliary brush as shown in FIG. 3, in which the auxiliary brush is not used but the extension pipe mounted with the auxiliary brush is coupled with another extension pipe.
Figure 4B:
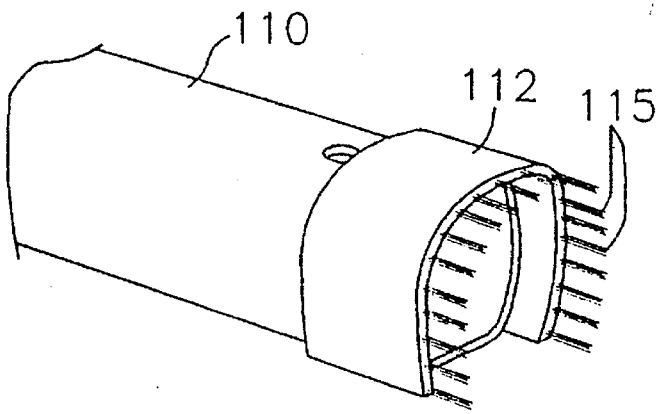
FIG. 4B is a view illustrating a state of using the suction tube mounted with the conventional auxiliary brush as shown in FIG. 3, in which the auxiliary brush fully expands out from the extension pipe mounted with the auxiliary brush.
Figure 4C:
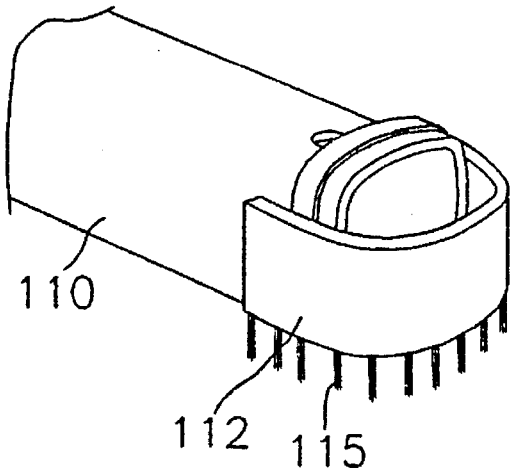
FIG. 4C is a view illustrating a state of using the suction tube mounted with the conventional auxiliary brush as shown in FIG. 3, in which the auxiliary brush expands by half from the extension pipe mounted with the auxiliary brush.
Figure 5:
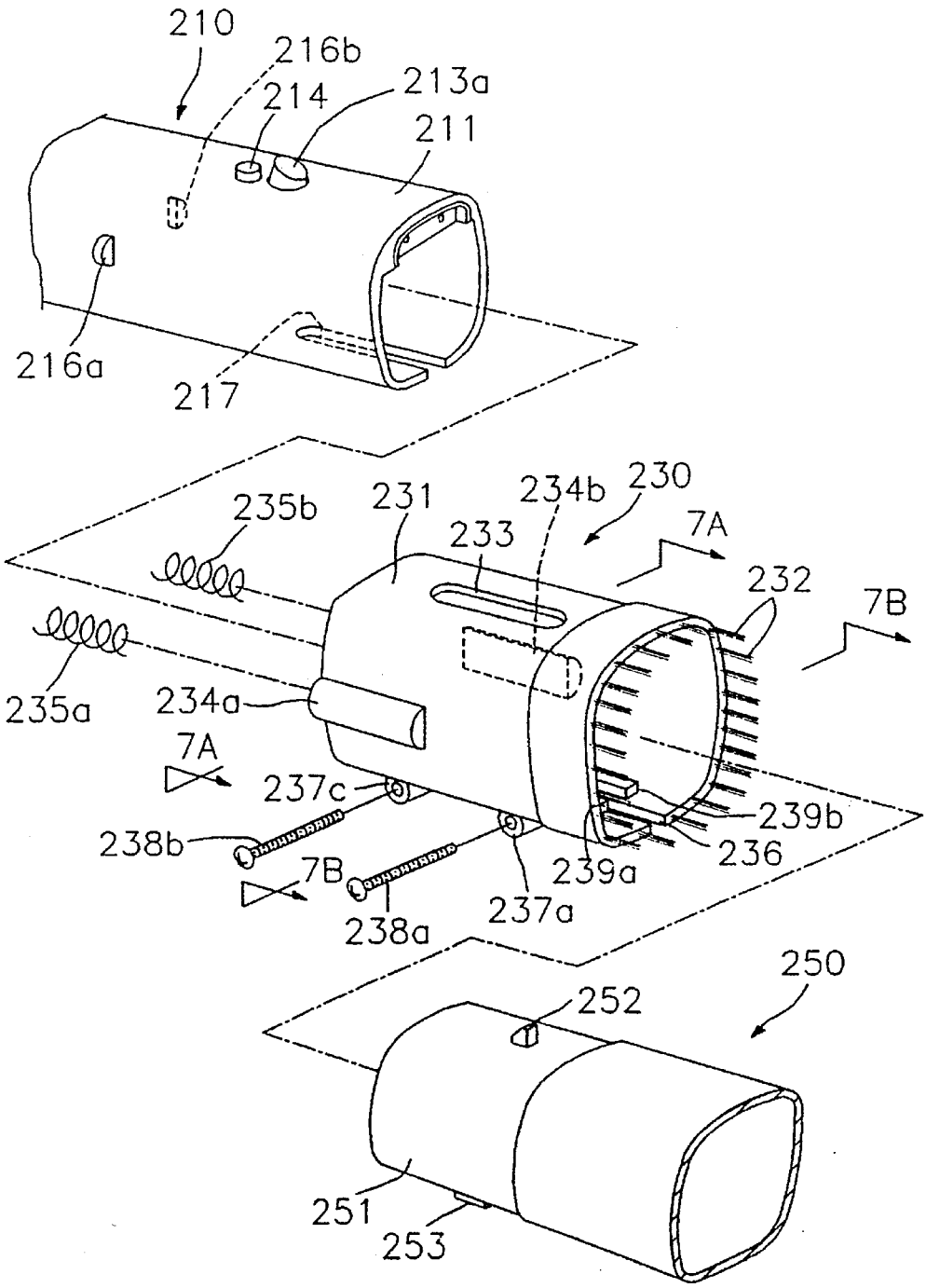
FIG. 5 is an exploded perspective view showing a first embodiment of a suction tube mounted with an auxiliary brush of a vacuum cleaner according to the present invention.
Figure 6:
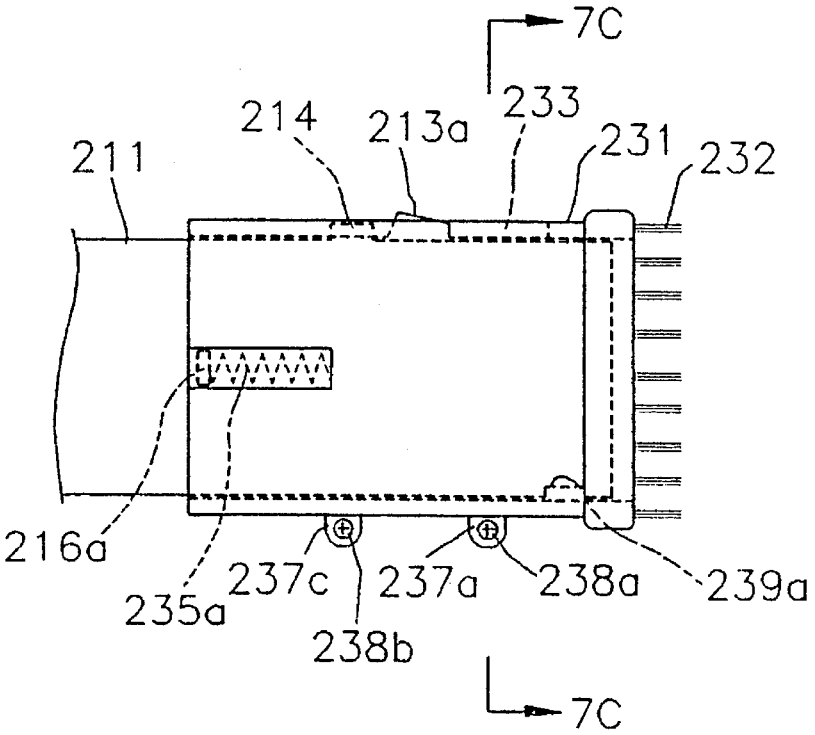
FIG. 6 is a side view of the first embodiment of the suction tube mounted with the auxiliary brush according to the present invention.
Figure 7A:
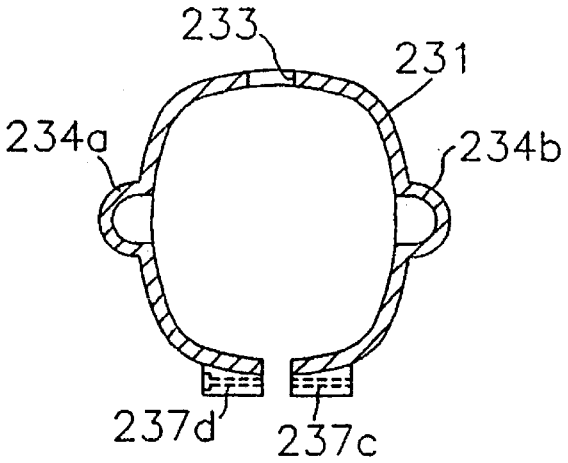
FIG. 7A is a sectional view taken along line 7A—7A of FIG. 5.
Figure 7B:
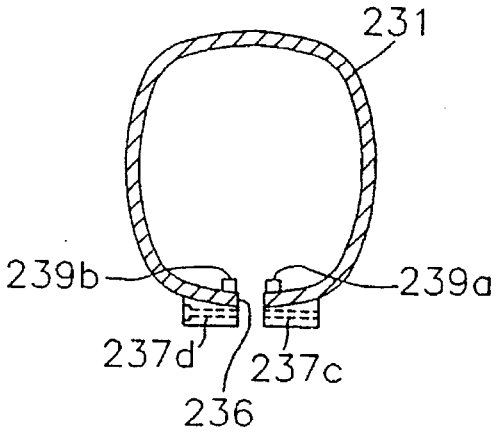
FIG. 7B is a sectional view taken along line 7B—7B of FIG. 5.
Figure 7C:
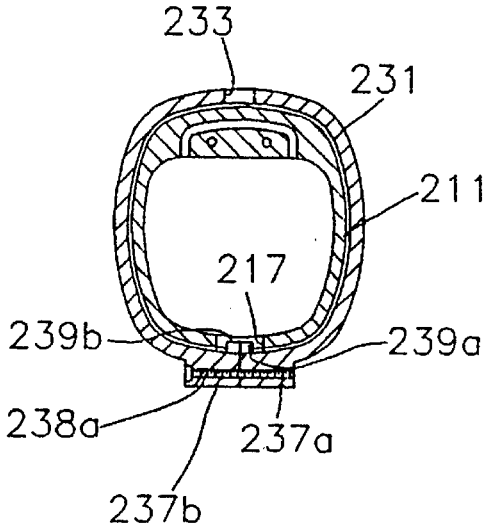
FIG. 7C is a sectional view taken along line 7C—7C of FIG. 6.
Figure 8A:
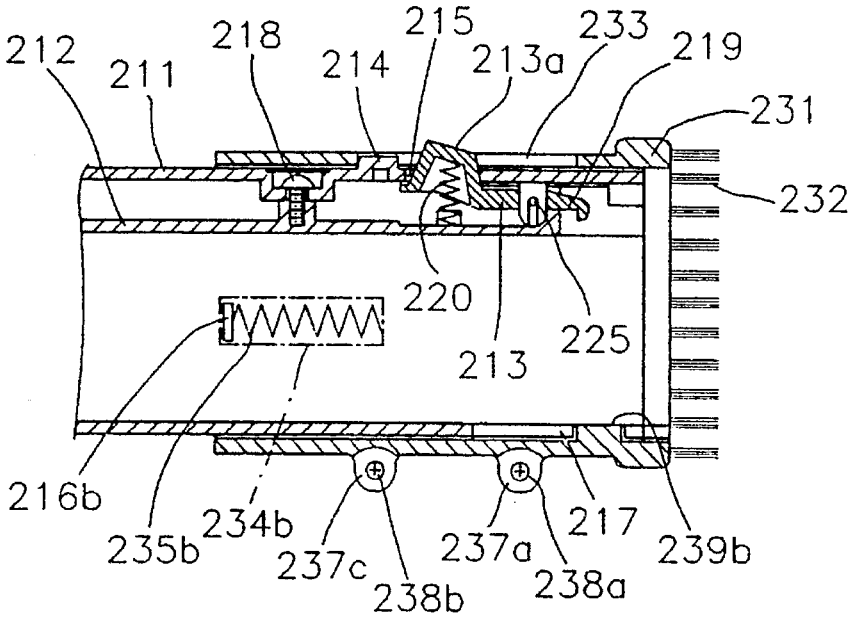
FIG. 8A is a view illustrating a state of using the first embodiment of the suction tube mounted with the auxiliary brush according to the present invention, in which the auxiliary brush projects out of the preceding end of the first extension pipe.
Figure 8B:
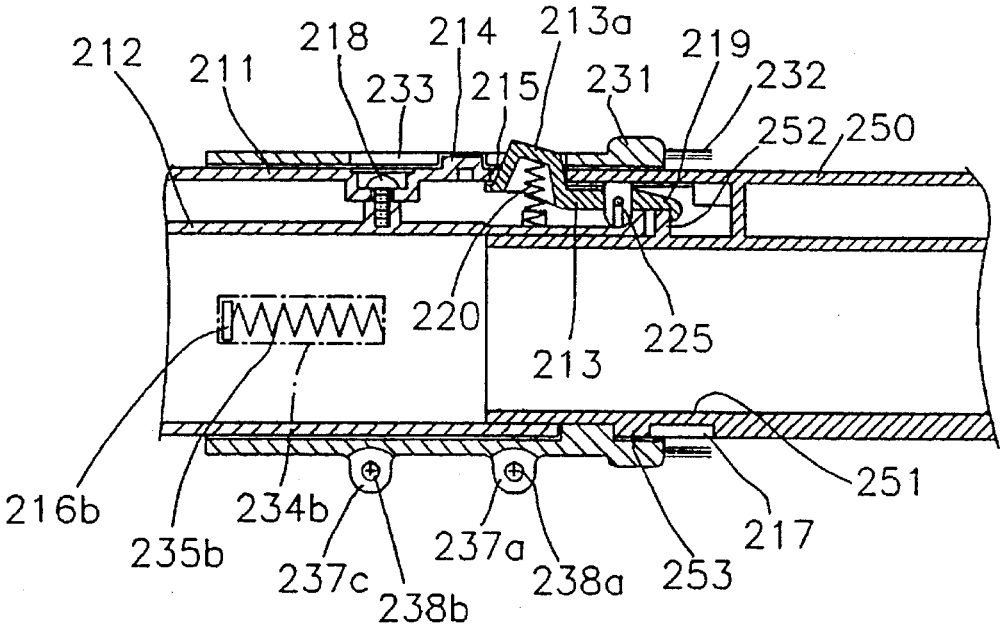
FIG. 8B is a view illustrating a state of using the first embodiment of the suction tube mounted with the auxiliary brush according to the present invention, in which the second extension pipe is coupled to the first extension pipe.

FIGS. 5 to 8B illustrate a first embodiment of a suction tube mounted with an auxiliary brush of a vacuum cleaner according to the present invention.

Referring to FIGS. 5 to 8B, the suction tube mounted with the auxiliary brush of the vacuum cleaner according to the present invention includes a first extension pipe 210, an auxiliary brush 230 and a second extension pipe 250.

First extension pipe 210 has an extension pipe body 211, a subplate 212 and a latching member 213. A stopper 214 and a through hole 215 are formed into the upper wall of extension pipe body 211, and a pair of backing ledges 216*a* and 216*b* are embeddedly projected on both sidewalls thereof. Also, a slot 217 is formed in the bottom wall of extension pipe body 211. Subplate 212 is fixed to the inner side of extension pipe body 211 by means of a clamping member 218. Latching member 213 formed with a press button 213*a* on one side thereof is pivotally supported by one side of subplate 212, and press button 213*a* penetrates through through hole 215 to be upwardly biased by means of a spring 220. A latch 219 is formed to opposite end of press button 213*a* of latching member 213.

Auxiliary brush 230 is slidably coupled to the outer periphery of extension pipe body 210. Auxiliary brush 230 has a brush body 231 and a dust brush 232 integrally molded with brush body 231. An elongated hole 233 for retaining press button 213*a* and stopper 214 of extension pipe body 210 is formed in the upper wall of brush body 231. Elongated hole 233 has one end being in contact with stopper 214 when auxiliary brush 230 sufficiently projects out of the preceding end of extension pipe body 210, and the other end being adjacent to press button 213*a* when auxiliary brush 230 sufficiently retreats from the preceding end of extension pipe body 210. A pair of spring grooves 234*a* and 234*b* are formed in both sides of brush body 231, and a pair of springs 235*a* and 235*b* are accommodated in spring grooves 234*a* and 234*b*. One ends of a pair of springs 235*a* and 235*b* are supported by pair of backing ledges 216*a* and 216*b* of extension pipe body 210. Thus, auxiliary brush 230 is biased to the front side of extension pipe body 210 by pair of backing ledges 216*a* and 216*b* and pair of springs 235*a* and 235*b*. A cutaway part 236 is formed in the lengthwise direction of the bottom wall of brush body 231, and two pairs of bosses 237*a* & 237*b* and 237*c* & 237*d* are spaced from each other to be symmetrical to each other to the outer side of the bottom wall of brush body 231. Two pairs of bosses 237*a* & 237*b* and 237*c* & 237*d* are coupled with clamp members 238*a* and 238*b*. By this coupling, auxiliary brush 230 is coupled to the outer periphery of extension pipe body 210 to be slidably moved in the lengthwise direction. A pair of juts 239*a* and 239*b* are formed to both sides of cutaway part 236 in the inner bottom wall of brush body 230. Pair of juts 239*a* and 239*b* are formed to protrude toward the inside of slot 217 of extension pipe body 210 when auxiliary brush 230 is assembled to extension pipe body 210.

Second extension pipe 250 includes a neck 251. A hooking jaw 252 embeddedly projects from the outer upper side of neck 251. The rear side of hooking jaw 252 is slightly slanted to facilitate an upward pushing of the preceding end of latch 219 by being in contact with the preceding end of latch 219 when second extension pipe 250 is inserted into the interior of first extension pipe 210. Hooking jaw 252 is engaged with latch 219 to serve for safely holding second extension pipe 250 within first extension pipe 210. A bottom protrusion 253 is formed to the outer bottom side of neck 251 to be fitted with pair of juts 242*a* and 242*b* of auxiliary brush 230 to retreat auxiliary brush 230 from the preceding end of first extension pipe 210.

In the suction tube mounted with the auxiliary brush of the vacuum cleaner according to the present invention constructed as above, once second extension pipe 250 is inserted into first extension pipe 210 when auxiliary brush 230 is not used, bottom protrusion 253 of second extension pipe 250 is advanced into slot 217 formed in extension pipe body 211 of first extension pipe 210. In turn, bottom protrusion 253 of advancing second extension pipe 250 pushes pair of juts 242*a* and 242*b* of auxiliary brush 230 with the consequence of retreating auxiliary brush 230 to the rear side of first extension pipe 210. By the insertion of second extension pipe 250 to first extension pipe 210, hooking jaw 252 of second extension pipe 250 comes in contact with latch 219 of latching member 213, and the preceding end of latch 219 ascends along the rear slanted plane of hooking jaw 252. Once second extension pipe 250 further advances into first extension pipe 210, hooking jaw 252 goes through the preceding end of latch 219. However, since latching member 213 formed with latch 219 is pivotally supported by subplate 212 of first extension pipe 210 by means of spring 220 in the opposite side of latch 219, the preceding end of latch 219 then descends by spring 220. Accordingly, latch 219 of first extension pipe 210 is fitted with hooking jaw 252 of second extension pipe 250. Therefore, second extension pipe 250 is joined into first extension pipe 210. At the same time, auxiliary brush 230 retreats from the preceding end of first extension pipe 210 to be safely stored (refer to FIG. 8B).

In the meantime, if the user intends to use auxiliary brush 230, second extension pipe 250 is separated from first extension pipe 210 while auxiliary brush 230 projects out of the preceding end of first extension pipe 210 only by the user's pressing of press button 213*a* which protrudes by penetrating through through hole 215 formed in extension pipe body 211 of first extension pipe 210. In more detail, when the user presses press button 213*a* with a finger, latch 219 formed to the opposite side of press button 213*a* from a pivot point 225 is upwardly moved centering about pivot point 225 since latching member 213 having press button 213*a* thereon is pivotally supported by subplate 212 of first extension pipe 210. If the preceding end of latch 219 is further moved upward to be free from the upper end of hooking jaw 252 of second extension pipe 250, auxiliary brush 230 biased in a forward direction of first extension pipe 210 by means of pair of springs 235*a* and 235*b* is moved in the forward direction of first extension pipe 210. Therefore, second extension pipe 250 is also separated out of first extension pipe 210 by pair of juts 242*a* and 242*b* of auxiliary brush 230 and bottom protrusion 253 of second extension pipe 250. By simply pressing press button 213*a* as described above, auxiliary brush 230 projects from the preceding end of first extension pipe 210 by the force of pair of springs 235*a* and 235*b*. As the result, the user can carry out the cleaning operation by using auxiliary brush 230 (refer to FIGS. 8A and 6).

Thus, in the suction tube mounted with the auxiliary brush of the vacuum cleaner according to the present invention constructed as above, just the simple manipulation of inserting second extension pipe 250 to first extension pipe 210 simultaneously enables two manipulations of retreating auxiliary brush 230 from the preceding end of first extension pipe 210 and coupling second extension pipe 250 to first extension pipe 210. Also, the manipulation of simply pressing press button 213*a* simultaneously separates second extension pipe 250 from first extension pipe 210 and projects auxiliary brush 230 out of the preceding end of first extension pipe 210. As a consequence, the extension pipes are coupled with each other and the auxiliary brush can retreat from the preceding end of the suction tube by the simple manipulation which further separates the extension pipes from each other and projects the auxiliary brush from the preceding end of the suction tube.

In addition to the above advantages, there is no need to open any portion of brush body 231 and dust brush 232 of auxiliary brush 230 mounted to first extension pipe 210 in the suction tube mounted with the auxiliary brush of the vacuum cleaner according to the present invention constructed as above. Thus, a space brought about when auxiliary brush 230 comes in contact with a plane subjected for cleaning does not occur between auxiliary brush 230 and the plane cleaned, thereby preventing the degradation of cleaning efficiency caused by the above space.

Figure 9:
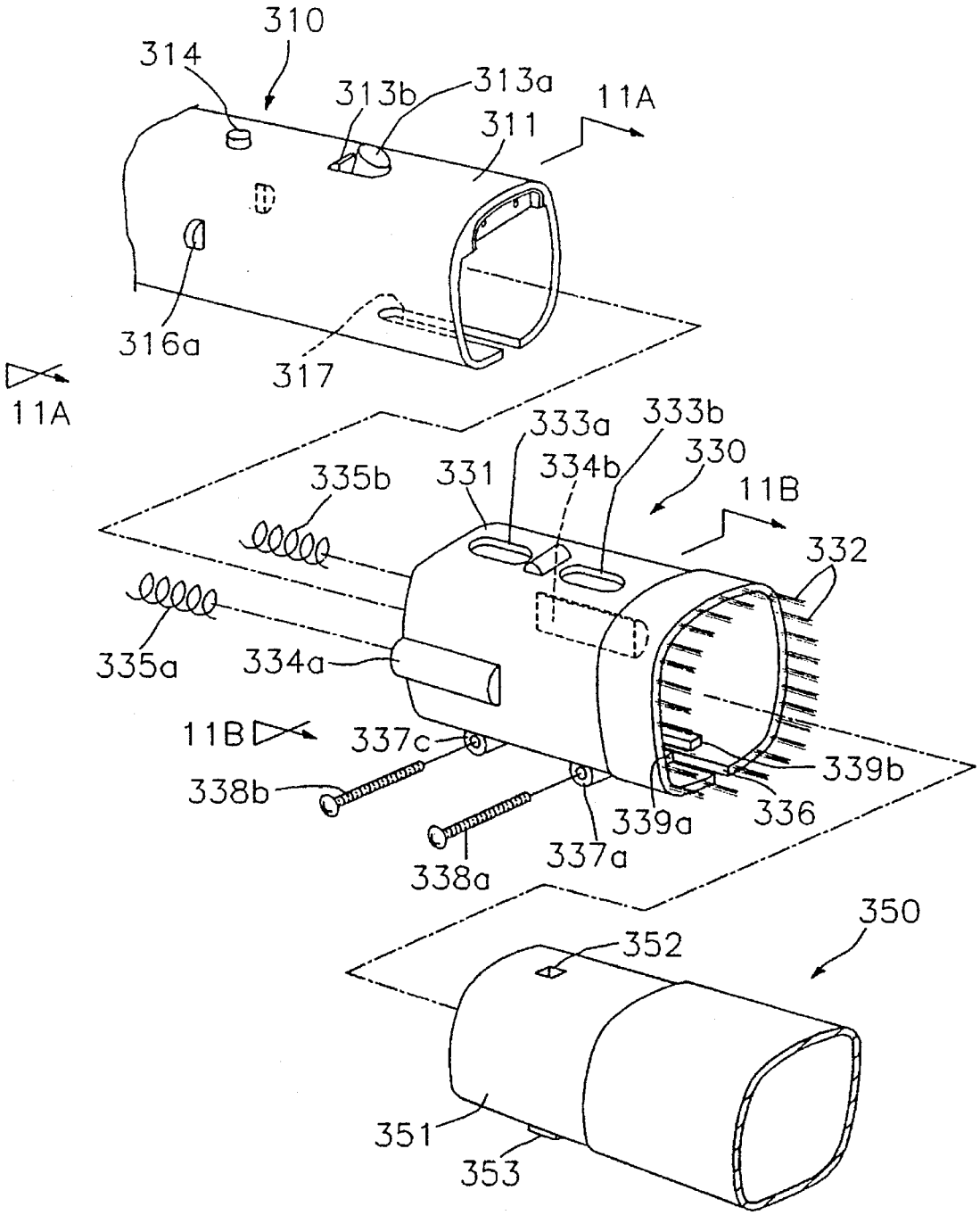
FIG. 9 is an exploded perspective view showing a second embodiment of the suction tube mounted with the auxiliary brush according to the present invention.
Figure 10:
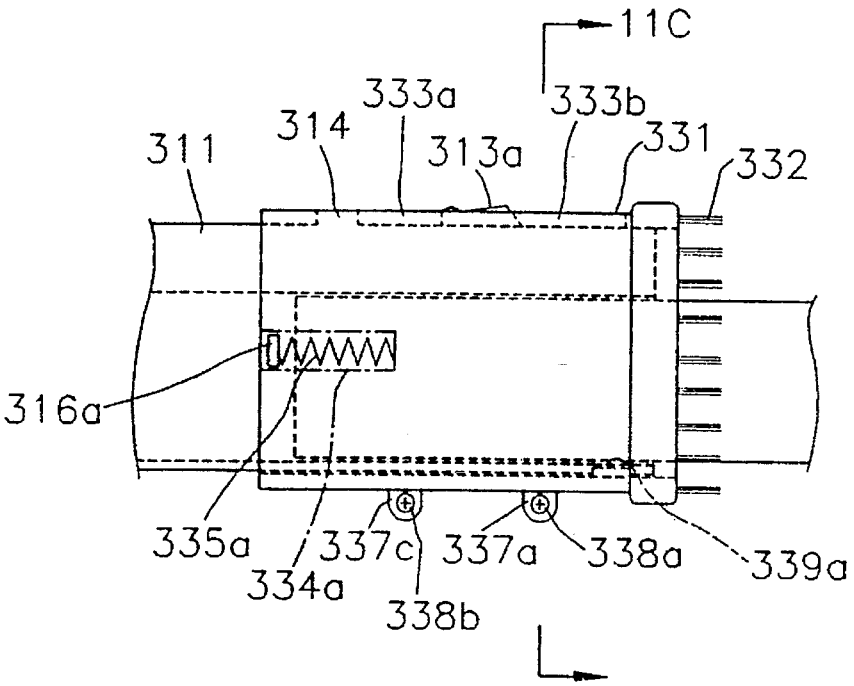
FIG. 10 is a side view showing the second embodiment of the suction tube mounted with the auxiliary brush according to the present invention.
Figure 11A:
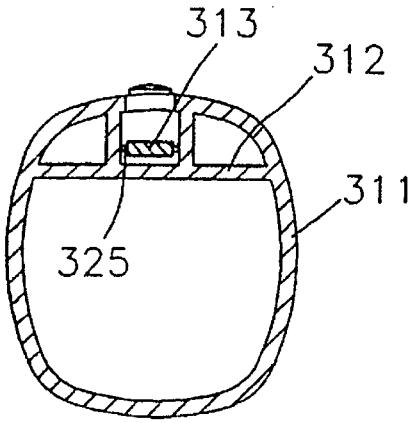
FIG. 11A is a sectional view taken along line 11A—11A of FIG. 9.
Figure 11B:
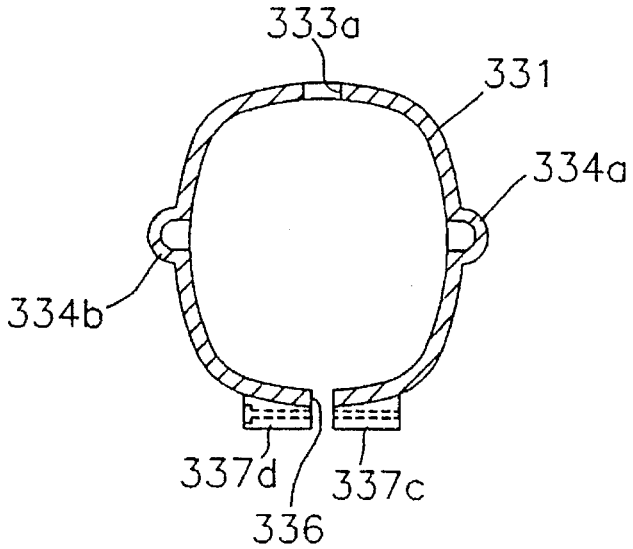
FIG. 11B is a sectional view taken along line 11B—11B of FIG. 9.
Figure 11C:
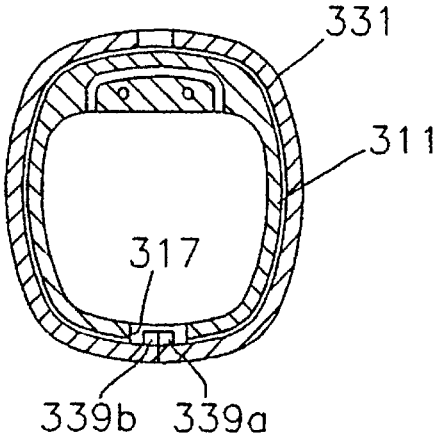
FIG. 11C is a sectional view taken along line 11C—11C of FIG. 10.
Figure 12A:
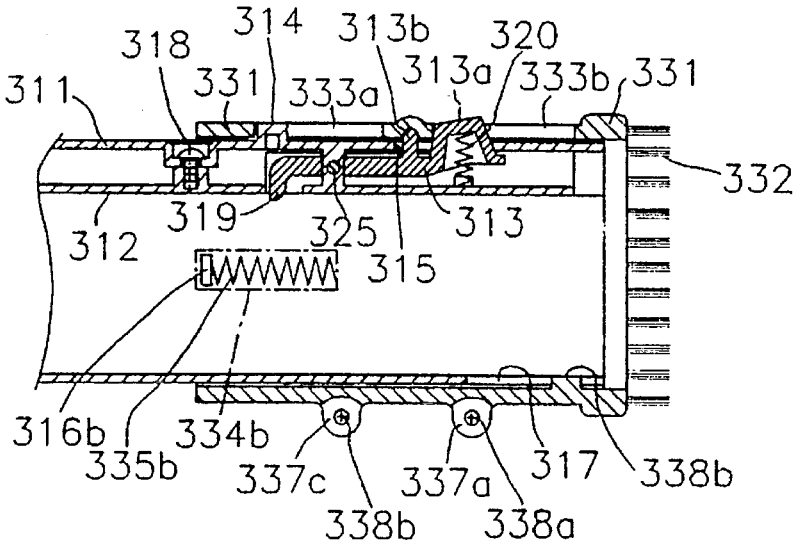
FIG. 12A is a view illustrating a state of using the second embodiment of the suction tube mounted with the auxiliary brush according to the present invention, in which the auxiliary brush projects out of the preceding end of the first extension pipe.
Figure 12B:
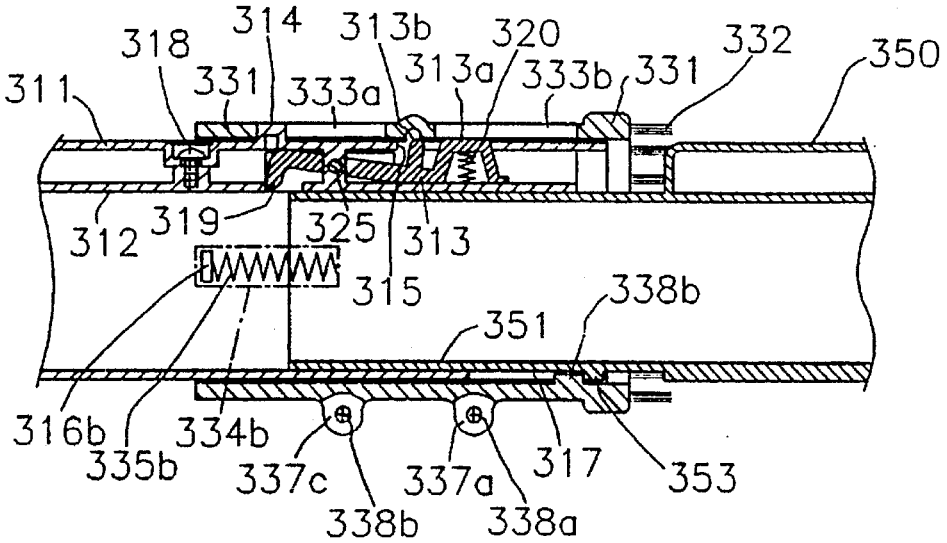
FIG. 12B is a view illustrating a state of using the second embodiment of the suction tube mounted with the auxiliary brush according to the present invention, in which the second extension pipe is being coupled to the first extension pipe.
Figure 12C:
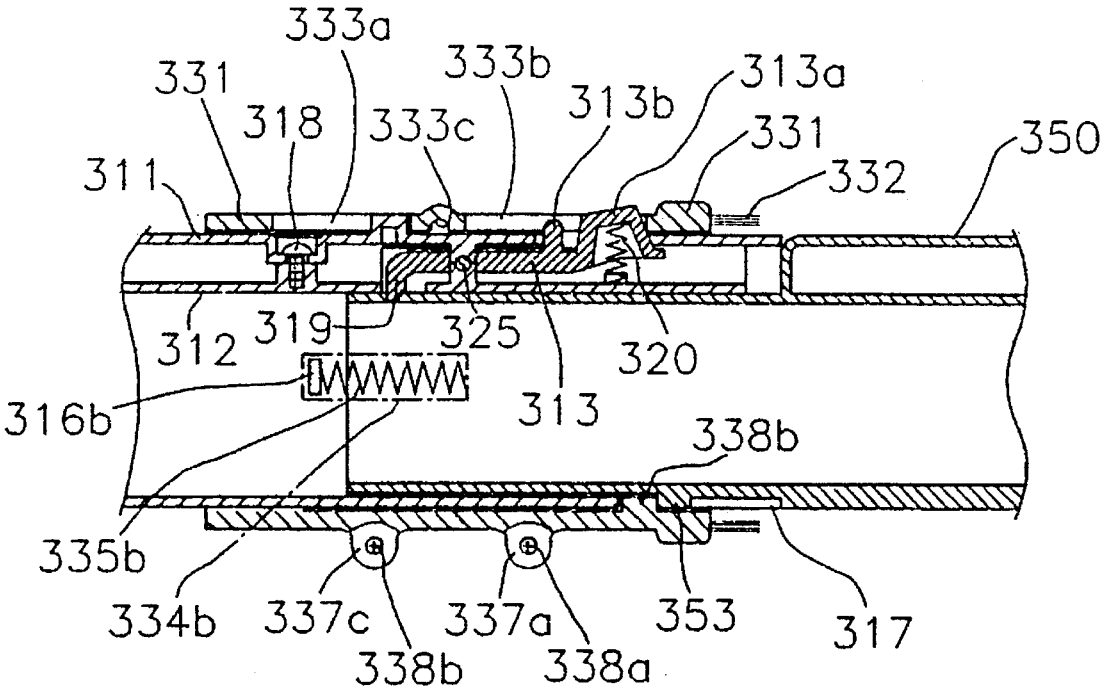
FIG. 12C is a view illustrating a state of using the second embodiment of the suction tube mounted with the auxiliary brush according to the present invention, in which the second extension pipe is completely coupled to the first extension pipe.

FIGS. 9 to 12C illustrate a second embodiment of the suction tube mounted with the auxiliary brush of the vacuum cleaner according to the present invention.

Referring to FIGS. 9 to 12C, the suction tube mounted with the auxiliary brush of the vacuum cleaner according to the present invention includes a first extension pipe 310, an auxiliary brush 330 and a second extension pipe 350.

First extension pipe 310 includes an extension pipe body 310, a subplate 312 and a latching member 313. A stopper 314 and a through hole 315 are formed into the upper wall of extension pipe body 311, and a pair of backing ledges 316*a* and 316*b* are embeddedly projected on both sidewalls thereof. Also, a slot 317 is formed in the bottom wall of extension pipe body 311. Subplate 312 is fixed to the inner side of extension pipe body 311 by means of a clamping member 318. Latching member 313 is pivotally joined to subplate 312, and one rear end of latching member 313 is formed with a hook-shaped latch 319 and one preceding end thereof has a press button 313*a* which is biased by means of a spring 320 against subplate 312 to protrude by penetrating through through hole 315 formed in extension pipe body 311 of first extension pipe 310. An auxiliary brush fixing protrusion 313*b* is formed to one rear side of press button 313*a*. The frontal corner of latch 319 is formed to be slightly slanted or rounded to smoothly slide by being in contact with the preceding corner of a neck 351 of second extension pipe 350 when second extension pipe 350 is inserted into first extension pipe 310.

Auxiliary brush 330 is slidably coupled to the outer periphery of extension pipe body 310. Auxiliary brush 330 has a brush body 331 and a dust brush 332 integrally molded with brush body 331. A first elongated hole 333*a* for retaining stopper 314 of extension pipe body 310 and a second elongated hole 333*b* for retaining a button 313*a* and auxiliary brush fixing protrusion 313*b* of latching member 313 are formed in the upper wall of brush body 313. First elongated hole 333*a* has one rear end being in contact with stopper 314 when auxiliary brush 330 sufficiently projects out of the preceding end of extension pipe body 310. An auxiliary brush fixing protrusion holding groove 333*c* is formed between first elongated hole 333*a* and second elongated hole 333*b* in the inner side of brush body 331. Auxiliary brush fixing protrusion holding groove 333*c* is provided to be engaged with auxiliary brush fixing protrusion 313*b* formed to latching member 313. A pair of spring grooves 334*a* and 334*b* are formed in both sides of brush body 331, and a pair of springs 335*a* and 335*b* are accommodated in spring grooves 334*a* and 334*b*, respectively. One ends of pair of springs 335*a* and 335*b* are supported by pair of backing ledges 316*a* and 316*b* of extension pipe body 310. Thus, auxiliary brush 330 is biased to the front side of extension pipe body 310 by means of pair of backing ledges 316*a* and 316*b* and pair of springs 335*a* and 335*b*. A cutaway part 336 is formed in the lengthwise direction of the bottom wall of brush body 331, and two pairs of bosses 337*a* & 337*b* and 337*c* & 337*d* are spaced from each other to be symmetrical to each other to the outer side of the bottom wall of brush body 331. Two pairs of bosses 337*a* & 337*b* and 337*c* & 337*d* are coupled with clamp members 338*a* and 338*b*. By this coupling, auxiliary brush 330 is coupled to be slidably moved along the outer periphery of extension pipe body 310 in the lengthwise direction. A pair of juts 339*a* and 339*b* are formed to both sides of cutaway part 336 in the inner bottom wall of brush body 330. Pair of juts 339*a* and 339*b* are formed to protrude toward the inside of slot 317 of extension pipe body 310 when auxiliary brush 330 is assembled to extension pipe body 310.

Second extension pipe 350 includes neck 351. A latching groove 352 is formed in the outer upper side of neck 351. Latching groove 352 is fitted with latch 319 to function by safely accommodating second extension pipe 350 within first extension pipe 310. A bottom protrusion 353 is formed to the outer bottom side of neck 351. Bottom protrusion 353 is to be fitted with pair of juts 342*a* and 342*b* of auxiliary brush 330 when second extension pipe 350 is inserted into first extension pipe 310 to force auxiliary brush 330 to retreat from the preceding end of first extension pipe 310.

In the suction tube mounted with the auxiliary brush of the vacuum cleaner according to the present invention constructed as above, once second extension pipe 350 is inserted into first extension pipe 310 when auxiliary brush 330 is not used, the end of neck 351 of second extension pipe 350 comes in contact with latch 319 of latching member 313. In turn, latching member 313 is rotated while centering about a pivot point 325 to ascend latch 319. As latching member 313 is rotated, auxiliary brush fixing protrusion 313*b* formed on the opposite side of latch 319 begins descending, so that auxiliary brush fixing protrusion 313*b* is shifted away from auxiliary brush fixing protrusion holding groove 333*c* in brush body 331. Then, once second extension pipe 350 is further advanced within first extension pipe 310, bottom protrusion 353 formed to neck 351 of second extension pipe 350 is advanced into slot 317 formed in extension pipe body 311 of first extension pipe 310, and bottom protrusion 353 of advancing extension pipe 350 is fitted with pair of juts 342*a* and 342*b* of auxiliary brush 330. Thereafter, along with the further advancing of second extension pipe 350 into first extension pipe 310, auxiliary brush 330 also retreats to the rear side of first extension pipe 310. If second extension pipe 350 further advances into first extension pipe 310, dust brush 332 of auxiliary brush 330 thoroughly retreats from the preceding end of first extension pipe 310. At this time, the preceding end of latch 319 is placed on latching groove 352 formed in neck 351 of second extension pipe 350. However, since latching member 313 formed with latch 319 is pivotally supported by subplate 312 and biased by spring 320 in the opposite side of latch 319 centering about pivot point 325, the preceding end of latch 319 then descends by means of spring 320. Accordingly, latch 319 of first extension pipe 310 is fitted into latching groove 352 of second extension pipe 350. Therefore, second extension pipe 350 is joined into first extension pipe 310. At the same time, auxiliary brush 330 retreats from the preceding end of first extension pipe 310 to be safely stored.

In the meantime, if the user intends to use auxiliary brush 230, second extension pipe 350 is separated from first extension pipe 310 while auxiliary brush 330 projects out of the preceding end of first extension pipe 310 only by the user's pressing of press button 313*a* which protrudes by penetrating through through hole 315 formed in extension pipe body 311 of first extension pipe 310. In more detail, when the user presses press button 313*a* with the finger, latch 319 formed to the opposite side of pivot point 325 is upwardly moved centering about pivot point 325 since latching member 313 having press button 313*a* thereon is pivotally supported by subplate 312 of first extension pipe 310. Therefore, latch 319 is shifted away from latching groove 352 of second extension pipe 350. Auxiliary brush 330 biased in a forward direction of first extension pipe 310 by means of pair of springs 335*a* and 335*b* is moved in the forward direction of first extension pipe 310. Thus, second extension pipe 350 is also separated out of first extension pipe 310 by pair of juts 342*a* and 342*b* of auxiliary brush 330 and bottom protrusion 353 of second extension pipe 350. Auxiliary brush 330 is moved until the rear end of first elongated hole 333*a* comes in contact with stopper 314 formed to extension pipe body 311 of first extension pipe 310. When the rear side of first elongated hole 333*a* contacts stopper 314 to stop the movement of auxiliary brush 330, auxiliary brush fixing protrusion holding groove 333*c* formed in the inner side of brush body 331 of auxiliary brush 330 is placed to the upper side of auxiliary brush fixing protrusion 313*b* of latching member 313. At this time, if the user removes his finger from press button 313*a*, auxiliary brush fixing protrusion 313*b* ascends to be fitted into auxiliary brush fixing protrusion holding groove 333*c*. By simply pressing press button 313*a* described as above, auxiliary brush 330 projects from the preceding end of first extension pipe 310 to be secured to a prescribed position.

Thus, in the suction tube mounted with the auxiliary brush of the vacuum cleaner according to the present invention constructed as above, just the simple manipulation of inserting second extension pipe 350 to first extension pipe 310 simultaneously enables two manipulations of retreating auxiliary brush 330 from the preceding end of first extension pipe 310 and coupling second extension pipe 350 to first extension pipe 310. Also, the manipulation of simply pressing press button 313*a* simultaneously separates second extension pipe 350 from first extension pipe 310 and projects auxiliary brush 330 out of the preceding end of first extension pipe 310. As a consequence, the extension pipes are coupled with each other and the auxiliary brush can retreat from the preceding end of the suction tube by the simple manipulation which further separates the extension pipes from each other and projects the auxiliary brush from the preceding end of the suction tube.

Besides, even when the cleaning is performed by pushing auxiliary brush 330 to the place cleaned, auxiliary brush 330 is not pushed against first extension pipe 310 since auxiliary brush 330 is fixed to first extension pipe 310 by the engagement of auxiliary brush fixing protrusion 313*b* and auxiliary brush fixing protrusion holding groove 333*c* in the suction tube mounted with the auxiliary brush of the vacuum cleaner to be able to execute the efficient cleaning work.

In addition to the above advantages, there is no need to open any portion of brush body 331 and dust brush 332 of auxiliary brush 330 mounted to first extension pipe 310 in the suction tube mounted with the auxiliary brush of the vacuum cleaner according to the present invention constructed as above. Thus, a space does not occur between auxiliary brush 330 and a plane subjected for cleaning, which is brought about when auxiliary brush 330 comes in contact with the plane cleaned, thereby preventing degradation of cleaning efficiency caused by the above space.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A suction tube mounted with an auxiliary brush of a vacuum cleaner comprising:

a first extension pipe;

a second extension pipe having a neck inserted into the interior of said first extension pipe;

said auxiliary brush mounted to the outer periphery of said first extension pipe to be slidably moved in the lengthwise direction of said first extension pipe, said auxiliary brush having a brush body and a dust brush integrally formed with said brush body in one piece;

means for biasing said auxiliary brush toward the front side of said first extension pipe;

means in opposition to said biasing means for retracting said auxiliary brush toward the rear side of said first extension pipe; and latching means having a press button for latching said second extension pipe into said first extension pipe when said second extension pipe is completely inserted within said first extension pipe and, at the same time, maintaining said auxiliary brush at a position retreating from the preceding end of said first extension pipe, and releasing the latching by the manipulation of said press button.

2. A suction tube mounted with an auxiliary brush of a vacuum cleaner as claimed in claim 1, wherein said biasing means comprises a pair of backing ledges formed to an outer side of both sidewalls of an extension pipe body of said first extension pipe, a pair of spring grooves formed in the inner side of both sidewalls of said brush body of said auxiliary brush for accommodating said backing ledges to one rear sides of them, and a pair of springs respectively having one ends supported by said backing ledges and the other ends supported by one preceding ends of said spring grooves to be held within said spring grooves.

3. A suction tube mounted with an auxiliary brush of a vacuum cleaner as claimed in claim 2, wherein said retracting means comprises a pair of juts embeddedly projecting from both inner walls of a slit formed in a bottom wall of said brush body of said auxiliary brush to be accommodated within a slot formed in said bottom wall of said extension pipe body of said first extension pipe for moving backward and forward within said slot, and a bottom protrusion formed to an outer side of a bottom wall of said neck of said second extension pipe.

4. A suction tube mounted with an auxiliary brush of a vacuum cleaner as claimed in claim 2, wherein said latching means comprises a latching member pivotally coupled to a subplate of said first etension pipe having a hook-shaped latch on one front side and a press button on the opposite side of said latch being biased by means of a spring with respect to said subplate to project by penetrating through a through hole formed in said extension pipe body of said first extension pipe, and a hooking jaw formed to an outer side of said upper wall of said neck of said second extension pipe to be fitted with said latch of said latching member.

5. A suction tube mounted with an auxiliary brush of a vacuum cleaner as claimed in claim 1, wherein said retracting means comprises a pair of juts embeddedly projecting from both inner walls of a slit formed in a bottom wall of said brush body of said auxiliary brush to be accommodated within a slot formed in said bottom wall of said extension pipe body of said first extension pipe for moving backward and forward within said slot, and a bottom protrusion formed to an outer side of a bottom wall of said neck of said second extension pipe.

6. A suction tube mounted with an auxiliary brush of a vacuum cleaner as claimed in claim 5, wherein said latching means comprises a latching member pivotally coupled to a subplate of said first extension pipe having a hook-shaped latch on one front side and a press button on the opposite side of said latch being biased by means of a spring with respect to said subplate to project by penetrating through a through hole formed in said extension pipe body of said first extension pipe, and a hooking jaw formed to an outer side of said upper wall of said neck of said second extension pipe to be fitted with said latch of said latching member.

7. A suction tube mounted with an auxiliary brush of a vacuum cleaner as claimed in claim 1, wherein said latching means comprises a latching member pivotally coupled to a subplate of said first extension pipe having a hook-shaped latch on one front side and a press button on the opposite side of said latch being biased by means of a spring with respect to said subplate to project by penetrating through a through hole formed in said extension pipe body of said first extension pipe, and a hooking jaw formed to an outer side of said upper wall of said neck of said second extension pipe to be fitted with said latch of said latching member.

8. A suction tube mounted with an auxiliary brush of a vacuum cleaner comprising:

a first extension pipe;

a second extension pipe having a neck inserted into the interior of said first extension pipe;

said auxiliary brush mounted to the outer periphery of said first extension pipe to be slidable in the lengthwise direction of said first extension pipe, said auxiliary brush having a brush body and a dust brush integrally formed with said brush body in one piece;

means for biasing said auxiliary brush toward the front side of said first extension pipe;

means in opposition to said biasing means for retracting said auxiliary brush toward the rear side of said first extension pipe; and latching means for latching said second extension pipe into said first extension pipe and, at the same time, maintaining said auxiliary brush at a position retreating from the preceding end of said first extension pipe when said second extension pipe is completely inserted within said first extension pipe, and fixing said auxiliary brush to a prescribed projecting position with respect to said first extension pipe when the latching is released to project said auxiliary brush from said preceding end of said first extension pipe.

9. A suction tube mounted with an auxiliary brush of a vacuum cleaner as claimed in claim 8 wherein said biasing means comprises a pair of backing ledges formed to an outer side of both sidewalls of an extension pipe body of said first extension pipe, a pair of spring grooves formed in the inner side of both sidewalls of said brush body of said auxiliary brush for accommodating said backing ledges to one rear sides of them, and a pair of springs respectively having one ends supported by said backing ledges and the other ends supported by one preceding ends of said spring grooves to be held within said spring grooves.

10. A suction tube mounted with an auxiliary brush of a vacuum cleaner as claimed in claim 9, wherein said retracting means comprises a pair of juts embeddedly projecting from both inner walls of a slit formed in a bottom wall of said brush body of said auxiliary brush to be accommodated within a slot formed in said bottom wall of said extension pipe body of said first extension pipe for moving backward and forward within said slot, and a bottom protrusion formed to an outer side of a bottom wall of said neck of said second extension pipe.

11. A suction tube mounted with an auxiliary brush of a vacuum cleaner as claimed in claim 9, wherein said latching means comprises a latching member pivotally coupled to a subplate of said first extension pipe having a hook-shaped latch on one rear end thereof, a press button biased by means of a spring with respect to said subplate to project by penetrating through a through hole formed in said extension pipe body of said first extension pipe on one front end thereof and an auxiliary brush fixing protrusion to one rear side of said press button; a latching groove formed in the outer side of the upper wall of said neck of said second extension pipe to be fitted with said latch of said latching member; and an auxiliary brush fixing protrusion holding groove formed in the inner side of said brush body of said auxiliary brush for being fitted with said auxiliary brush fixing protrusion of said latching member.

12. A suction tube mounted with an auxiliary brush of a vacuum cleaner as claimed in claim 8, wherein said retracting means comprises a pair of juts embeddedly projecting from both inner walls of a slit formed in a bottom wall of said brush body of said auxiliary brush to be accommodated within a slot formed in said bottom wall of said extension pipe body of said first extension pipe for moving backward and forward within said slot, and a bottom protrusion formed to an outer side of a bottom wall of said neck of said second extension pipe.

13. A suction tube mounted with an auxiliary brush of a vacuum cleaner as claimed in claim 12, wherein said latching means comprises a latching member pivotally coupled to a subplate of said first extension pipe having a hook-shaped latch on one rear end thereof, a press button biased by means of a spring with respect to said subplate to project by penetrating through a through hole formed in said extension pipe body of said first extension pipe on one front end thereof and an auxiliary brush fixing protrusion to one rear side of said press button; a latching groove formed in the outer side of the upper wall of said neck of said second extension pipe to be fitted with said latch of said latching member; and an auxiliary brush fixing protrusion holding groove formed in the inner side of said brush body of said auxiliary brush for being fitted with said auxiliary brush fixing protrusion of said latching member.

14. A suction tube mounted with an auxiliary brush of a vacuum cleaner as claimed in claim 8, wherein said latching means comprises a latching member pivotally coupled to a subplate of said first extension pipe having a hook-shaped latch on one rear end thereof, a press button biased by means of a spring with respect to said subplate to project by penetrating through a through hole formed in said extension pipe body of said first extension pipe on one front end thereof and an auxiliary brush fixing protrusion to one rear side of said press button; a latching groove formed in the outer side of the upper wall of said neck of said second extension pipe to be fitted with said latch of said latching member; and an auxiliary brush fixing protrusion holding groove formed in the inner side of said brush body of said auxiliary brush for being fitted with said auxiliary brush fixing protrusion of said latching member.

* * * * *